United States Patent [19]

van Muyen

[11] 3,946,788

[45] Mar. 30, 1976

[54] FOLDABLE CURTAIN SCREEN OR BLIND CONSTRUCTION AND A METHOD FOR PRODUCING A CURTAIN BLIND CONSTRUCTION

[75] Inventor: Hendrik van Muyen, Sliedrecht, Netherlands

[73] Assignee: Blydenstein-Willink N.V., Enschede, Netherlands

[22] Filed: June 28, 1974

[21] Appl. No.: 484,061

[52] U.S. Cl. ..... 160/84 R
[51] Int. Cl.[2] ..... E06B 9/26
[58] Field of Search ..... 160/84 R, 22

[56] References Cited

UNITED STATES PATENTS

| | | | |
|---|---|---|---|
| 1,663,819 | 3/1928 | Shaft | 160/84 R |
| 2,247,260 | 6/1941 | Stone | 160/84 R |
| 2,290,808 | 7/1942 | Lunken | 160/22 |
| 3,599,702 | 8/1971 | Bedard | 160/84 R |

*Primary Examiner*—Kenneth Downey
*Attorney, Agent, or Firm*—Harness, Dickey & Pierce

[57] ABSTRACT

A screen or blind construction comprising a plurality of overlapped, horizontally reversely folded sections. The sections, including the overlapped portions, are provided with aligned holes through which vertical cords are passed. The cords provide lifting means for the blind as well as preventing horizontal separation of the overlapped sections.

8 Claims, 2 Drawing Figures

FOLDABLE CURTAIN SCREEN OR BLIND CONSTRUCTION AND A METHOD FOR PRODUCING A CURTAIN BLIND CONSTRUCTION

The invention relates to foldable curtain screen or blind constructions.

Such screen or blind constructions are generally formed from a web-type material which retains its folds, for example inpregnated textile fabric, paper or board-type material, metallized textile material etc. Other materials may also be used, such as plastics and even metal. The problem which occurs in the case of such foldable curtain blind constructions is the width restrictions to which one is bound on account of the mechanically prepared standard web widths.

The production of a blind whose width is smaller than that of the manufactured web requires critical cutting of the web, with the loss of material resulting therefrom.

The preparation of a screen or blind of a larger width requires a wider manufactured web width, either the use of a second web, cutting to the desired width thereof, with the subsequent loss of material, or fastening the webs together to form a whole. Hitherto these two unfavourable complicated and expensive methods were used alongside each other.

According to the invention there is provided a foldable curtain screen or blind construction wherein the screen or blind is assembled with a final width which can be determined as required from a plurality of corrugated or zig-zag folded loosely overlapping web portions of the same and/or different width wherein the corrugations or folds of the overlapping web portions are identical in shape and direction and continue in their longitudinal direction which differs from the folding direction over the web portions and wherein guide members keep the loose web portions permanently in place relative to each other at their point of overlap.

In the construction proposed, one may start from a plurality of web portions which are manufactured separately or are cut without any loss of material from webs of the standard width and then positioned. In this way, for example, when proceeding from a minimum desired width of 80 cm, three web portions with widths of 45, 50 and 55 cm and/or three web portions with widths of 40, 50 and 60 cm can be cut out from standard webs 150 cm wide. By combining web portions of the same or different widths a blind can be formed of practically any width in a simple and quick way without any loss of material wherein the guide members keep the loosely overlapping web portions in place relative to each other at their point of overlap. Obviously, the choice of the widths of the web portions is free and can be fitted to the place of use. In this way, by adding a web portion of 25 cm and with the two above rows of web portion any width from 40 cm can be achieved with a maximum width difference of 5 cm.

In a preferred embodiment of the guide members they consists of elongate members which are attached by a set of overlapping zones or along these overlapping zones of the web portions. In a practical embodiment the elongate members continue in the aligned holes in the said overlapping zones. The web portion can be supplied to the builder/assembler with the holes already made.

A very practical and simple embodiment of the curtain blind construction is obtained if according to a further feature of the invention the elongate members consist of flexible members, such as cords or strips which form actuating members for folding and unfolding the blind. In this case, the elongate members thus serve a double function.

If, according to a further feature of the invention, the web portions have different widths, the difference between the adjoining widths being ± 5 cm, then by a combination of these web portions blind widths can be assembled, increasing at the most with the said difference, which screen widths are sufficient to meet particularly all the demands and restrictions which appear in practice.

By providing the overlapping zones of the web portions with a specific width, the blind can be made to the exact size. This can be achieved for example by proceeding from measuring the exact size, choosing the nearest web portions and then determining the exact place for the holes for the operating cords and then punching out these holes. If the overlapping zones with the different widths are correctly distributed over the screen or blind, then a regular pattern results which is completely acceptable as regards the external appearance even when using material which is to some extent transparent.

The invention further comprises a method for preparing a guided, foldable curtain blind construction with a final width which can be determined as required, consisting of:

a. the formation of a blind or screen from a number of loose web portions of the same or different width, by joining together the web portions in a loose overlapping position,
b. making wavy or zig-zag shaped folds or loops in the blind material before or after in such a way that these folds or loops for the different web portions coincide with each other as regards shape and direction, and continue in their longitudinal direction which differ from the folding direction over the web portions,
c. keeping each two abutting, loosely overlapped web portions in place in the overlapping position of the said web portions by attaching guide members through the overlapping zones of the web portions or along these said zones,. Holes may be made in the overlapping zones before or after the web portions are joined together.

A preferred embodiment of this method of operation is characterized in that more or less the final width is maintained by selecting the constituent overlapping web portions, and the final width is achieved by making the aligned holes in the overlapping zones of the web portions at a position to be determined for this purpose.

The invention will now be explained by way of example with reference to the accompanying drawings.

Figure 1:
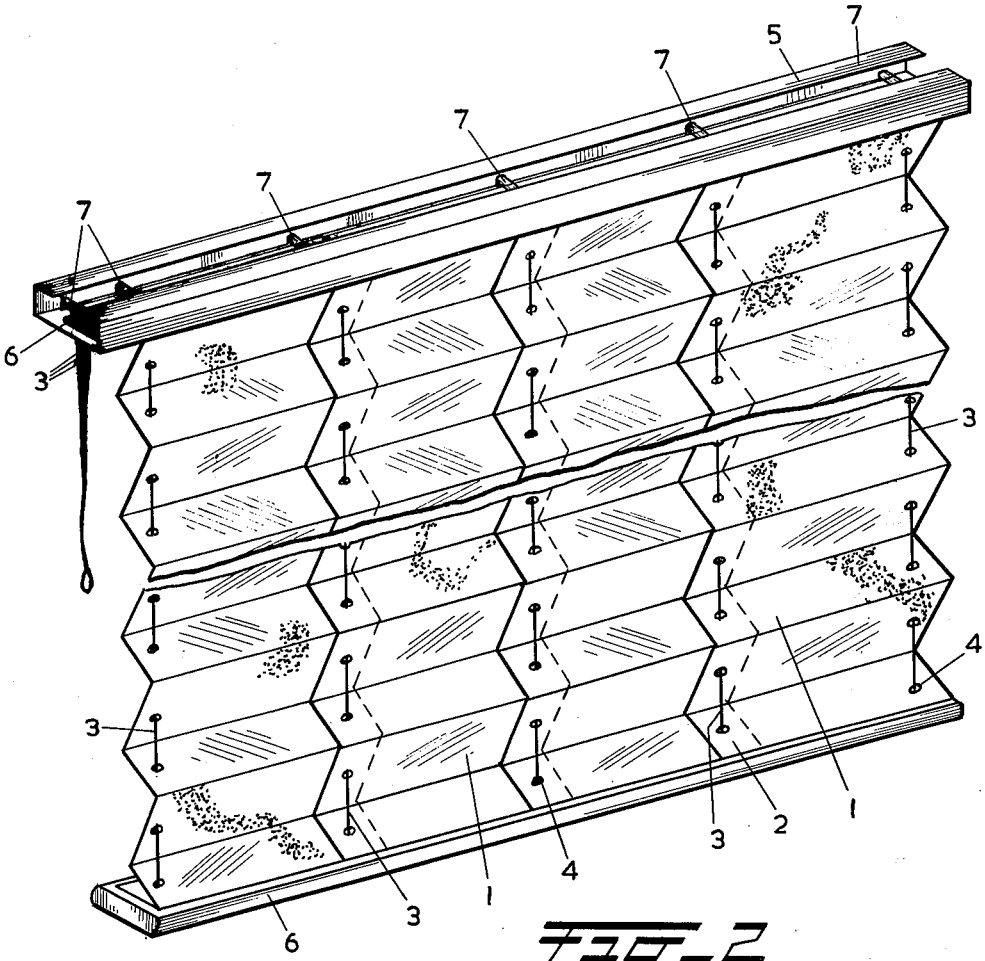
FIG. 1 is a perspective view of a screen or blind construction according to the invention.

The drawing only illustrates examples of two embodiments of the curtain blind construction according to the invention. The invention is not restricted to these embodiments, but includes all variations which may fall within the claims.

In FIG. 1, the curtain blind construction is shown in the unfolded state. The blind is formed with a final width which is to be determined from choice - in the embodiment illustrated - from four zig-zag folded web portions 1 which at their longitudinal edges loosely overlap each other and in their embodiment do not all have the same width. The folds of the overlapping web portions are identical in shape and direction and continue in the longitudinal direction over the web portion. In the illustrated embodiment, the longitudinal direction of the folds is at right angles to the folding direction of the screen or blind. The web portions are held firmly in place relative to each other at the point of their overlapping zones 2 by flexible cords 3 which at the same time form the actuating members for folding and unfolding the blind. These cords which extend parallel relative to each other pass through holes 4 which are present in the overlapping zones and are in alignment for each two adjoining web portions. The upper rail is marked 5 and the lower rail 6. In the upper rail there are holes for the cords with rollers 7 positioned thereabove to act as a guide for the cords. In the embodiment illustrated, the upper rail 3 is at one end longer than the lower rail 6. In the protruding part of the upper rail there is a groove 8 with a roller mounted thereabove serving to lead out the cord. Furthermore, the illustrated embodiment of the rails 5 and 6 only serves as an example. The same applies to the way in which the blind is fastened to the rails.

Figure 2:
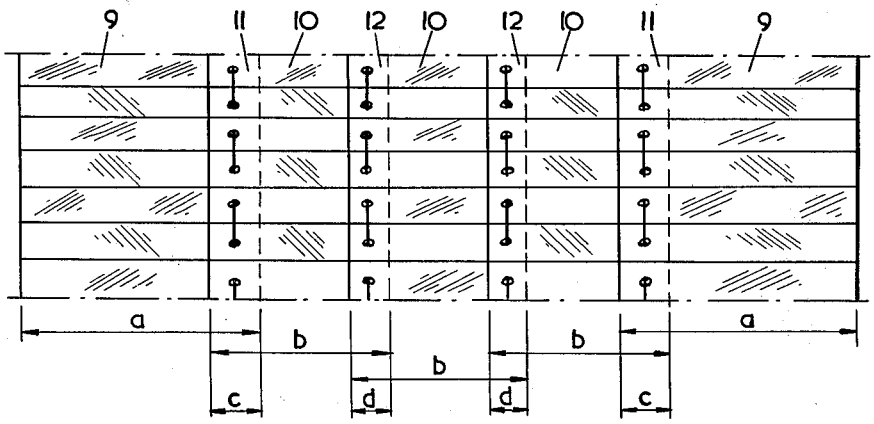
FIG. 2 is a front view of part of an embodiment of a screen or blind construction which is true to scale.

FIG. 2 illustrates the part of a blind which has received the required accurate size. This is achieved by taking five webs in this specific case wherein the two outer webs 9 have the same width $a$ and the three intermediate webs 10 have the same width $b$, wherein $a > b$. Approximately the desired width was obtained by this choice. The total overlapping width was then determined in the light of the given exact final size and the holes were made in the edges of the web portions so that of the four overlapping zones the two outer zones had a width $c$ and the two inner zones a width $d$ wherein $c > d$. A blind of precisely the desired size was obtained with a perfectly acceptable appearance. It will be seen that the webs 9 and 10 have lateral margins 11 and 12, respectively, which overlap the margins of the adjacent webs with the holes 4 of the overlapped margins being aligned for the free passage of the cords 7 therethrough.

It is clear that within the scope of the invention a large number of variations is possible so that any existing problem can be easily solved with these constructions, namely the blind can be made to any size required.

What we claim is:

1. A foldable curtain including a fixed upper rail, a movable lower rail, a plurality of flexible vertical cords extending vertically between said rails and guidably associated with said upper rail to permit the lifting of said lower rail when said cords are pulled and a plurality of vertical web sections extending between said rails, said web sections being horizontally reversely folded and having overlapping lateral margins provided with aligned holes receiving at least one of said cords whereby a curtain of a desired width may be constructed from a plurality of overlapping web sections which are selected from web sections of one or more standard widths, said cord extending through said aligned holes to prevent horizontal separating movement of the web sections.

2. The structure set forth in claim 1 in which the web sections are of at least two different standard widths.

3. The structure set forth in claim 1 in which said cords are fixed to said lower rail and in which said upper rail has rollers for guiding said cords.

4. The structure set forth in claim 1 in which said overlapping web sections are selected in both number and width from web sections having a plurality of standard widths.

5. The method of making a foldable curtain having a predetermined width which includes the steps of selecting top and bottom rails, selecting a plurality of web section of widths less than said predetermined width, said web sections being horizontally reversely folded and having perforated lateral margins, overlapping said web sections so as to align the perforations of the margins thereof and produce a web having a total width equal to said predetermined width and passing cords extending between said rails through the perforations of said overlapped sections to hold the overlapped margins of said web sections in registry and prevent horizontal separating movement thereof.

6. The method set forth in claim 5 in which said web sections are selected from standard web sections of varying width.

7. The method set forth in claim 5 in which said web sections are connected to one another solely by said cords.

8. The method set forth in claim 5 in which the number of said web sections is varied to produce a web of the desired predetermined width.

* * * * *